US005090554A

United States Patent [19]

De Sanctis

[11] Patent Number: 5,090,554

[45] Date of Patent: Feb. 25, 1992

[54] ROTARY DEVICE TO CHANGE THE DIRECTION OF ADVANCEMENT OF A PLASTIC CARD OR METAL PLATE IN A PUNCHING MACHINE

[75] Inventor: Oliviero De Sanctis, Carnate, Italy

[73] Assignee: Fima S.p.A., Milan, Italy

[21] Appl. No.: 669,989

[22] Filed: Mar. 15, 1991

[30] Foreign Application Priority Data

Mar. 20, 1990 [IT] Italy ..... 19727 A/90

[51] Int. Cl.[5] ..... B65G 29/00

[52] U.S. Cl. ..... 198/414; 271/184; 271/225; 198/631; 198/861.6

[58] Field of Search ..... 198/412, 414, 457, 631, 198/369, 587, 861.6; 271/184, 185, 225

[56] References Cited

U.S. PATENT DOCUMENTS

| | | | |
|---|---|---|---|
| 2,986,261 | 5/1961 | Wenstrand | 198/457 |
| 3,283,883 | 11/1966 | Cruzen, Jr. | 198/631 |
| 4,135,620 | 1/1979 | Harcuba et al. | 198/861.6 X |
| 4,349,097 | 9/1982 | Lusti | 198/631 |
| 4,457,419 | 7/1984 | Ogami et al. | 198/414 X |

FOREIGN PATENT DOCUMENTS

| | | | |
|---|---|---|---|
| 2205153 | 8/1973 | Fed. Rep. of Germany | 198/414 |
| 1087433 | 4/1984 | U.S.S.R. | 198/414 |

*Primary Examiner*—Robert P. Olszewski
*Assistant Examiner*—James R. Bridwell
*Attorney, Agent, or Firm*—Longacre & White

[57] ABSTRACT

A rotary device performing the task of changing the direction of advancement of a plastics card or metal plate, suitable for being inserted in a punching machine, constituted by a bearing structure, a linear conveyor for the plastics card or metal plate and a drive motor, in which the bearing structure comprises a lower, fixed framework, inside which the drive motor is housed, above which a upper, rotary framework is rotatably supported, on which the linear conveyor is positioned. A first positive transmission connects the drive motor with the upper, rotary framework of the structure, causing the upper, rotary framework to rotate by a predetermined angualr rotation, and a second positive transmission connects the drive motor with the linear conveyor which conveys the plastics card or metal plate. Between the two positive transmissions and the drive motor two free-wheel mechanisms are interposed, which cause the two positive transmissions to be selectively actuated.

10 Claims, 3 Drawing Sheets

Figure 1:
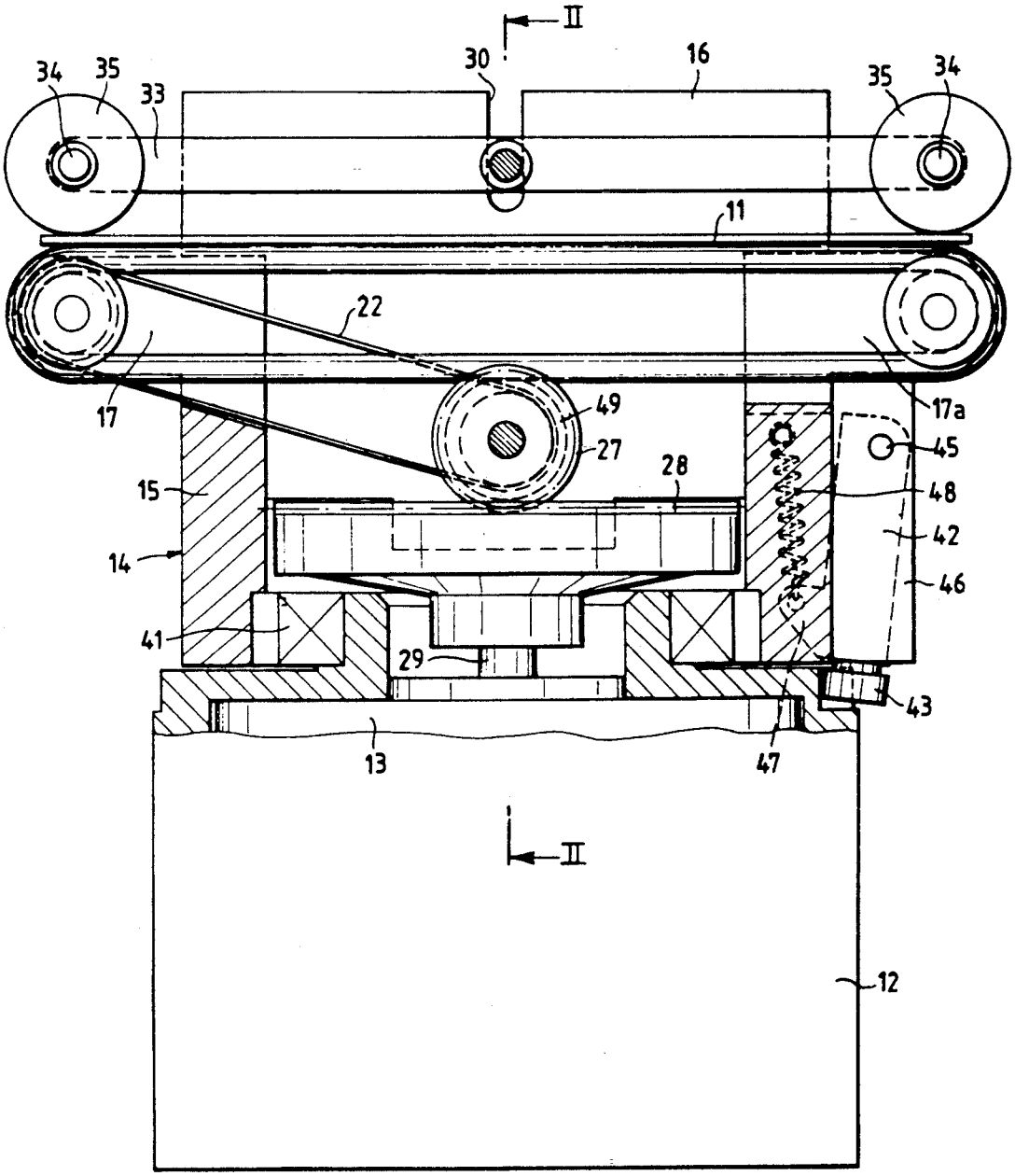

ROTARY DEVICE TO CHANGE THE DIRECTION OF ADVANCEMENT OF A PLASTIC CARD OR METAL PLATE IN A PUNCHING MACHINE

The present invention relates to a rotary device which performs the task of changing the direction of advancement of a plastics card or metal plate in a punching machine.

In the following, the term "punching machines" is generally understood to mean the machines used to personalize plastics cards or metal plates. The personalizing process consists in transferring alphanumerical data onto the support in question, made from either plastics material or metal material, as punched characters, or characters written by a whatever else writing technology, or coded as a recorded magnetic or electrical information.

In the punching machines of traditional type, the feed of the plastics card or metal plate—wherein, by the term "plastics card" a card is understood which may also be made from another material, and which, once punched, is used in a number of different applications, takes place according to an essentially linear path, since the several units which constitute said punching machine are arranged in sequence after each other in the same linear direction, with no direction changes.

Punching machines—also they constituted by a plurality of devices—are now being developed in which, on the contrary, due to their compactness and modularity, said advancement direction has to be sharply changed by a certain bending angle, to cause the card in course of treatment to advance from a device to the following device.

The purpose of the present invention is of providing a device which is capable of receiving a plastics card or metal plate or label emerging from a device or alternatively from a conveyor which transports it, rotating it by a certain angle and subsequently feeding it to a successive device or to a successive conveyor which will feed said card, plate or label to a further device.

This purpose according to the present invention is achieved by providing a rotary device which performs the task of changing the advancement direction of a plastics card or metal plate in a punching machine, which device is constituted by a bearing structure, a linear conveyor for said plastics card or metal plate and a drive motor means, characterized in that said bearing structure comprises a lower, fixed, hollow framework, inside which said drive motor means is housed, above which an upper rotary framework is rotatably supported, on which upper framework said linear conveyor is positioned, with a first positive transmission being provided, which connects said drive motor means with said upper rotary framework of said bearing structure and causes said upper, rotary framework to rotate by a predetermined angular rotation, and a second positive transmission being provided as well, which connects said drive motor means with said linear conveyor which conveys said plastics card or metal plate, and between said two positive transmissions and said drive motor means two free-wheel mechanisms being interposed, which cause said two positive transmissions to be selectively actuated.

Figure 2:
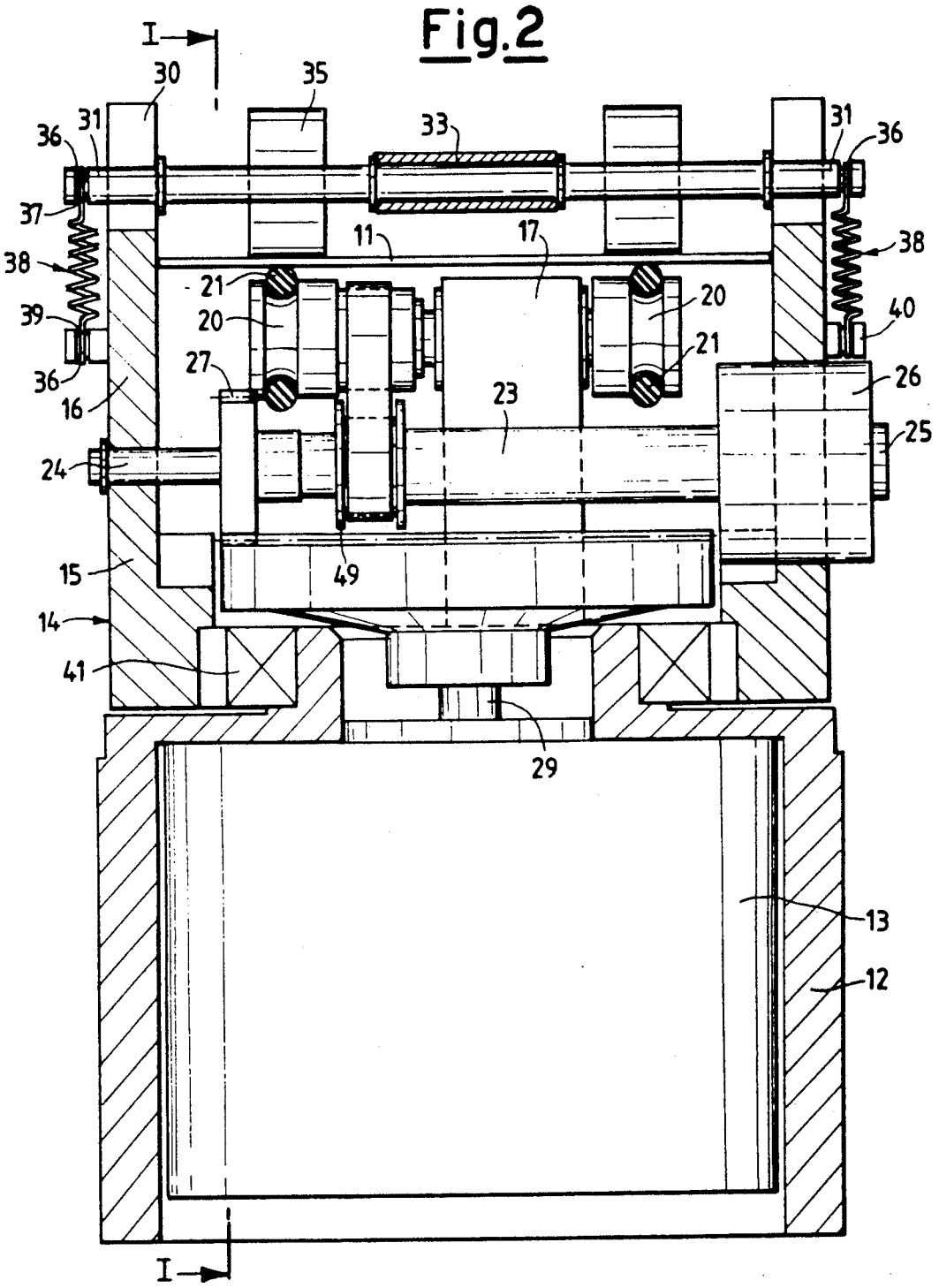
Figure 3:
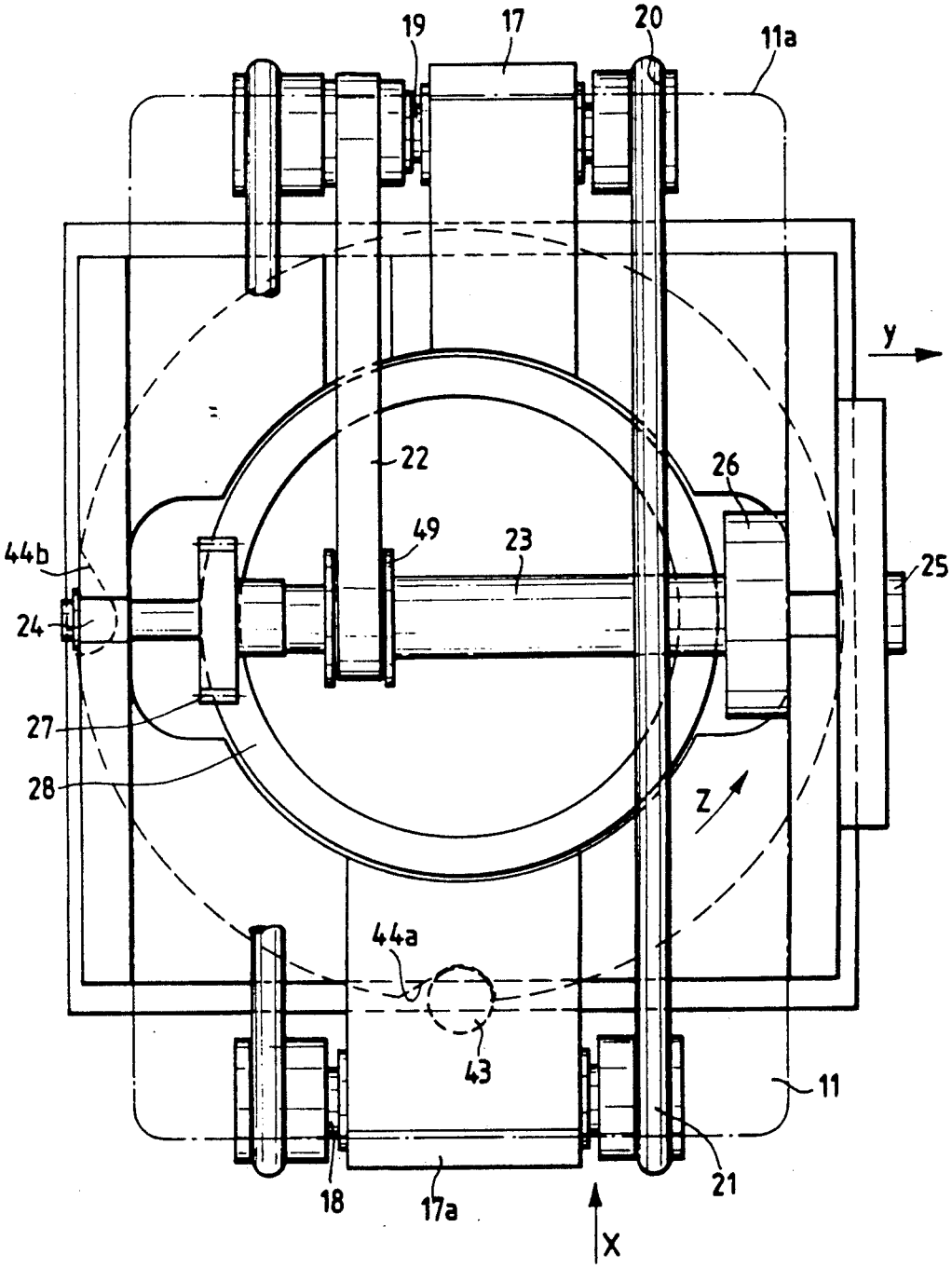

The structural and functional features and the advantages of a device according to the present invention will be better understood from the following exemplifying, non-limitative disclosure thereof, made by referring to the accompanying schematic drawings, in which:

FIG. 1 shows a sectional elevation view of the device according to the present invention, made according to the path line I—I of FIG. 2, FIG. 2 shows a sectional view according to the path line II—II of FIG. 1, and FIG. 3 shows a top plan view of the device according to the invention, with the top portion of the conveyor being removed.

Referring to the figures, a rotary device performing the task of changing the direction of advancement of a plastics card or metal plate schematically shown in 11, is arranged inside a punching machine (not shown) and is used to change by an angle the direction of advancement of the plastics card, or metal plate.

The rotary device according to the present invention is constituted by a bearing structure comprising a lower, fixed framework 12, hollow and containing a motor 13. Above said bearing structure an upper, rotary, hollow framework—indicated with the reference numeral 14—in installed. Between the fixed framework 12 and the rotary framework 14 a first free-wheel mechanism is installed, which enables said frameworks to revolve relatively to each other, in one revolution direction only. The motor 13 may be a stepper motor, or a whatever else type of motor, equipped with feedback sensors.

The upper, rotary framework 14 supports a conveyor means which, for the sake of simplicity, is called "linear conveyor" in its entirety, and is better disclosed in the following.

The upper, rotary, hollow framework 14 comprises a lower, essentially cylindrical portion 15, opposite to the lower framework 12, and two wall-shaped appendices 16 protruding upwards which support, between each other, the linear conveyor. More precisely, from said appendices 16 two central, horizontal portions 17–17*a* extend, radially protruding outwards, with the one of them being of a smaller size than the other one, which portions, inside relevant bores (not shown), rotatably house two shafts 18 and 19 at whose ends a pair of circular-shaped cross-section belts 21 run inside relevant annular seats 20. The belts 21 run along a path with flattened, elongated ring configuration and around said end support shafts 18 and 19. At least one of said shafts is operatively connected with a positive transmission.

Furthermore, the shaft 19 is driven to rotate by a transmission belt 22—coupled with said shaft 19 at a portion of said shaft comprised between one of the belts 21 and the smaller-size horizontal central portion 17—which connects said same shaft 19 with a pulley 49 installed on an intermediate shaft 23. Said intermediate shaft 23 is hinged at an end 24 thereof inside a wall-shaped appendix 16 of the upper framework 14 and at its other end 25 inside the other, opposite wall-shaped appendix 16, with the interposition of a second free-wheel mechanism generally indicated with the reference numeral 26. Thus, said belt 22 realizes the above said positive transmission between the underlying motor 13, a kinematic chain which is disclosed in greater detail in the following and the linear conveyor defined by the lower belts 21 and wheels which cooperate with said belts, as better illustrated in the following.

The intermediate shaft 23 supports, either keyed on it, or integrally made as one piece with it, a gear wheel 27, the bottom portion of which inmeshes with a contrate gear wheel 28 arranged perpendicular to the gear wheel 27. Said contrate gear wheel 28 draws its motion directly from the motor 13, because it is keyed on the shaft 29 extending from said motor. In that way, a further positive transmission of revolutionary motion is realized between the lower, fixed framework 12 and the upper, rotary framework 14.

In the upper portion of the wall-shaped appendices 16 housing grooves 30 are centrally provided, open upwards and capable of housing the ends 31 of a pivot 32 centrally bearing a flat rod 33, arranged parallel to the flat portion of the lower belts 21. Opposite ends of the flat rod 33 support further pivots 34 which at their ends bear pairs of idling wheels 35 so positioned as to be in front of the underlying belts 21.

Inside annular, recessed seats 36 provided on the ends 31 of the pivot 32, bent ends 37 of helical springs 38—in the example shown herein, extension springs—are housed. The other bent ends 39 of said springs are housed inside annular, recessed seats 36 provided on pivots 40 integral with, and radially protruding from, the appendices 16. Thus, the helical springs 38 keep the wheels 35 into contact with the upper surface of the belts 21, while allowing a plastics card or metal plate 11 to be inserted between, and/or removed from between, them.

Between the upper, rotary framework 14 and the lower, fixed framework 12 a first free-wheel mechanism is interposed, as said. This first free-wheel mechanism is constituted by a bearing 41, which enables the two parts to rotate relatively to each other, and a swinging lever 42 bearing, at one of its ends, a follower 43 suitable for entering inside escapement recesses **44*a* and 44*b* provided at the upper end of the side wall of the lower, fixed framework 12. At its other end, the lever 42 is hinged in 45, inside a seat 46, which is open outwards and is vertically and centrally provided in the lower, cylindrical portion 15 under the horizontal portion 17*a***.

In its bottom, outwards oriented portion, the lever 42 has an ear 47 to which an extension spring 48 is constrained. The other end of said extension spring 48 is linked to the other end of the lower, cylindrical portion, so as to keep the lever into contact with the lower, fixed framework 12, or even inside the interior of the escapement recesses **44*a* and 44*b*. In the example depicted herein, there are provided two escapement recesses 44*a* and 44*b* arranged at 90° to each other; said recesses could however be angularly offset by a different angle, i.e., corresponding to the desired angular rotation of the upper, rotary framework 14**.

A rotary device according to the present invention operates as briefly illustrated in the following. It is assumed that in the exemplary form of practical embodiment discussed herein, the plastics card or metal plate 11 fed to the device according to the direction X must be turned by an angle of 90° and must leave the same device running in the direction Y (FIG. 3).

FIG. 3 shows the position of the device of the invention during the step of said device receiving the plastics card or metal plate. During said step, a leading edge **11*a* of the plastics card or metal plate is moved to the region comprised between the belts 21 and the wheels 35**, so that the plastics card or metal plate can be completely received inside the linear conveyor defined by the above said belts and wheels. Such a feed of the plastics card or metal plate can take place, e.g., from a feeding conveyor means, not shown herein for the sake of simplicity.

Once that this leading edge is positioned and inserted between the belts 21 and the wheels 35, the motor 13 is actuated according to a revolutionary movement defined by the arrow Z and, in the herein shown example, in counterclockwise direction. Thanks to the presence of the first free-wheel mechanism—constituted by the follower 43, the escapement recess **44*a* and the bearing 41—such an actuation does not cause the upper, rotary framework 14** to rotate.

On the contrary, the shaft 29 transmits the revolutionary movement to the gear wheel 28 and consequently to the gear wheel 27 which causes the intermediate shaft 23 to rotate. In this revolution direction, the second free-wheel mechanism 26 can freely rotate and therefore can freely transmit the revolutionary motion through the belt 22, to the belts 21. Said belts 21, in cooperation with the wheels 35, cause the plastics card or metal plate 11 to advance until the latter reaches its position shown in chain line in FIG. 3, i.e., completely contained inside the linear conveyor.

At this time, the motor 13 stops and reverses its revolution direction. Said reversed revolution direction is therefore contrary to as indicated with the arrow Z, i.e., clockwise. Such a rotation of the motor—precisely due to the presence of both free-wheel devices arranged as said—enables then the upper, rotary framework 14 to rotate by 90°. As a consequence, the follower 43 leaves the first escapement recess **44*a* and enters the second escapement recess 44*b*; the motor stops. During this rotation, the presence of the second free-wheel mechanism 26 does not make it possible the motion to be transmitted to the circular-cross-section belts 21, which therefore remain stationary. The plastics card of metal plate 11 remains retained between them. No need to say that the rotation of the upper, rotary framework 14 takes place thanks to the cooperation between the contrate gear wheel 28 and the gear wheel 27**.

The upper framework 14 is thus positioned in a direction at an angle of 90° clockwise relatively to its position shown in FIG. 3. A further stop of the motor 13, and a further reversal of its revolution direction enables—in a similar way to as explained above—the belts 21 to be actuated and the rotation of the upper framework 14 to be simultaneouly blocked. As a consequence, the plastics card or metal plate 11 emerges from the linear conveyor, running in the direction indicated with the arrow Y.

Once that the plastics card or metal plate 11 is completely emerged from the linear conveyor and has been received, e.g., by a removing conveyor means (not shown herein), the device is rotated by 270° clockwise, so as to return back to its initial position (FIG. 3), ready to receive a further plastics card or metal plate fed to it, e.g., by a feeding conveyor means.

The rotary device according to the present invention makes it hence possible the direction of advancement to be varied of a plastics card or metal plate or label which must be moved between two successive devices, or simply fed to a device, with said devices being not mutually aligned, but arranged at a certain angle to each other. The angle of rotation can be selected as desired and is simply determined by the angular offset at which the escapement recesses are provided on the peripheral surface of the lower framework of the bearing structure. By providing more than two escapement recesses, one might also cause the device according to the present invention to perform the function of distributing the plastics cards or metal plates according to different directions, towards a plurality of downstream devices.

In an evident way, without however departing from the scope of protection of the instant finding, exactly contrary arrangements can be provided in the free-wheel mechanisms, i.e., the escapement recesses could be provided on the rotary framework and a follower 43 could be positioned on the fixed framework.

Advantageously, the device according to the present invention, equipped with a so engineered linear conveyor furthermore secures that the plastics card or metal plate or label will be handled without being notched or damaged, notwithstanding the presence of punched or relieved portions.

I claim:

1. Rotary device which performs the task of changing the advancement direction of a plastics card or metal plate in a punching machine, which device is constituted by a bearing structure, a linear conveyor for said plastics card or metal plate and a drive motor means, characterized in that said bearing structure comprises a lower, fixed, hollow framework, inside which said drive motor means is housed, above which an upper, rotary framework is rotatably supported, on which upper framework said linear conveyor is positioned, with a first positive transmission being provided, which connects said drive motor means with said upper rotary framework of said bearing structure and causes said upper, rotary framework to rotate by a predetermined angular rotation, and a second positive transmission being provided as well, which connects said drive motor means with said linear conveyor which conveys said plastics card or metal plate, with between said two positive transmissions and said drive motor means two free-wheel mechanisms being interposed, which cause said two positive transmissions to be selectively actuated.

2. Device according to claim 1, characterized in that one of said two free-wheel mechanisms is interposed between said upper, rotary framework and said lower, fixed framework and comprises, on one of said frameworks, at least one pair of escapement recesses offset relatively to each other by said predetermined angular rotation and on the other one of said frameworks, a follower capable of entering said pair of escapement recesses.

3. Device according to claim 2, characterized in that said follower is arranged on the free end of a lever swinging around a pivot provided at the other end of said lever and constrained to one of said frameworks, between said lever and said one of said frameworks an extension spring being interposed, which normally keeps said lever into contact with said frameworks.

4. Device according to claim 1, characterized in that said first positive transmission which connects said drive motor means with said upper, rotary framework comprises a contrate gear wheel keyed on a shaft extending from said drive motor means and a gear wheel rotatably supported on an intermediate shaft hinged onto said upper, rotary framework.

5. Device according to claim 4, characterized in that said second positive transmission which connects said drive motor means with said linear conveyor furthermore comprises a transmission belt interacting on one side with a driving shaft which performs the task of driving said linear conveyor, and on the other side with a pulley, also installed on said intermediate shaft.

6. Device according to claim 1, characterized in that said linear conveyor comprises a pair of lower belts running along a path of flattened and elongated ring shape, and around two end support shafts, with at least one of said shafts being operatively connected with said second positive transmission.

7. Device according to claim 6, characterized in that with said pair of lower belts idling wheels are associated, positioned above said belts, and interacting in resilient mode above them.

8. Device according to claim 7, characterized in that said idling wheels are positioned at the ends of pivots integral with a flat rod parallel to said pair of lower belts and supported by a further pivot which is housed inside grooved housings open upwards and which are provided on upper portions of walls of said upper, rotary framework.

9. Device according to claim 8, characterized in that between said further pivot which supports said flat rod and said upper portions of walls of said framework, helical springs are interposed.

10. Device according to claim 1, characterized in that both said free-wheel mechanisms are arranged in such a way that either of them prevents the revolution to take place in reversed direction relatively to the other one.

* * * * *